US011118475B2

(12) United States Patent
Synnott et al.

(10) Patent No.: US 11,118,475 B2
(45) Date of Patent: Sep. 14, 2021

(54) TURBINE SHROUD COOLING

(71) Applicant: PRATT & WHITNEY CANADA CORP., Longueuil (CA)

(72) Inventors: Remy Synnott, St-Jean-sur-Richelieu (CA); Mohammed Ennacer, St-Hubert (CA); Chris Pater, Longueuil (CA); Denis Blouin, Ste-Julie (CA); Kapila Jain, Kirkland (CA); Farough Mohammadi, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 56 days.

(21) Appl. No.: 16/750,401

(22) Filed: Jan. 23, 2020

(65) Prior Publication Data

US 2020/0277876 A1 Sep. 3, 2020

Related U.S. Application Data

(62) Division of application No. 15/840,088, filed on Dec. 13, 2017, now Pat. No. 10,570,773.

(51) Int. Cl.

| | |
|---|---|
| ***B22C 9/10*** | (2006.01) |
| ***F01D 25/12*** | (2006.01) |
| ***F01D 9/02*** | (2006.01) |
| ***F01D 17/10*** | (2006.01) |
| ***F01D 9/04*** | (2006.01) |
| ***F01D 11/08*** | (2006.01) |

(52) U.S. Cl.

CPC ..... *F01D 25/12* (2013.01); *B22C 9/10* (2013.01); *F01D 9/02* (2013.01); *F01D 9/04* (2013.01); *F01D 11/08* (2013.01); *F01D 17/105* (2013.01); *F05D 2220/32* (2013.01); *F05D 2230/211* (2013.01); *F05D 2240/11* (2013.01); *F05D 2240/81* (2013.01); *F05D 2260/221* (2013.01); *F05D 2260/22141* (2013.01)

(58) Field of Classification Search

CPC ..... F01D 11/24; F01D 11/12; F01D 11/122; F01D 11/08; F01D 25/12

See application file for complete search history.

(56) References Cited

U.S. PATENT DOCUMENTS

| | | | |
|---|---|---|---|
| 3,831,258 | A | 8/1974 | Elbert et al. |
| 4,137,619 | A | 2/1979 | Beltran et al. |
| 4,383,854 | A | 5/1983 | Dembowski et al. |
| 4,604,780 | A | 8/1986 | Metcalfe |
| 4,616,976 | A | 10/1986 | Lings |
| 4,871,621 | A | 10/1989 | Bagley et al. |
| 5,010,050 | A | 4/1991 | Wullenweber et al. |

(Continued)

*Primary Examiner* — Woody A Lee, Jr.
*Assistant Examiner* — Behnoush Haghighian
(74) *Attorney, Agent, or Firm* — Norton Rose Fulbright Canada LLP

(57) ABSTRACT

A turbine shroud segment has a body having a radially outer surface and a radially inner surface extending axially between a leading edge and a trailing edge and circumferentially between a first and a second lateral edge. A first serpentine channel is disposed axially along the first lateral edge. A second serpentine channel is disposed axially along the second lateral edge. The first and second serpentine channels each define a tortuous path including axially extending passages between a front inlet proximate the leading edge and a rear outlet at the trailing edge of the body.

6 Claims, 3 Drawing Sheets

(56) References Cited

U.S. PATENT DOCUMENTS 5,130,084 A 7/1992 Matheny et al.
5,486,090 A * 1/1996 Thompson ..... F01D 25/12 415/173.1
5,488,825 A 2/1996 Davis
5,538,393 A * 7/1996 Thompson ..... F01D 11/08 415/115
5,553,999 A 9/1996 Proctor et al.
5,574,957 A 11/1996 Barnard et al.
5,772,748 A 6/1998 Hubbard
5,933,699 A 8/1999 Ritter et al.
5,950,063 A 9/1999 Hens et al.
6,102,656 A 8/2000 Nissley et al.
6,196,799 B1 3/2001 Fukue
6,217,282 B1 4/2001 Stanka
6,350,404 B1 2/2002 Li et al.
6,547,210 B1 4/2003 Marx et al.
6,595,750 B2 * 7/2003 Parneix ..... F01D 5/187 416/97 R
6,679,680 B2 1/2004 Um et al.
6,709,771 B2 3/2004 Allister
6,776,955 B1 8/2004 Lim et al.
6,857,848 B2 2/2005 Fokine et al.
6,874,562 B2 4/2005 Knott et al.
6,910,854 B2 6/2005 Joslin
6,939,505 B2 9/2005 Musso et al.
6,974,308 B2 12/2005 Halfmann et al.
7,007,488 B2 3/2006 Orlando
7,029,228 B2 4/2006 Chan et al.
7,052,241 B2 5/2006 Decker
7,114,920 B2 10/2006 Synnott
7,128,522 B2 10/2006 Jutras
7,175,387 B2 2/2007 Kreis et al.
7,217,081 B2 5/2007 Scheurlen et al.
7,234,920 B2 6/2007 Imbourg et al.
7,306,424 B2 12/2007 Romanov
7,407,622 B2 8/2008 Voice et al.
7,513,040 B2 4/2009 Cunha
7,517,189 B2 * 4/2009 Camus ..... F01D 9/04 415/173.1
7,621,719 B2 11/2009 Lutjen
7,625,178 B2 * 12/2009 Morris ..... B22C 9/10 416/97 R
7,687,021 B2 3/2010 Imbourg et al.
7,785,067 B2 8/2010 Lee
7,857,581 B2 12/2010 Mons et al.
7,875,340 B2 1/2011 Cho et al.
8,246,298 B2 8/2012 Wilson
8,313,301 B2 11/2012 Hudson
8,366,383 B2 2/2013 Thibodeau
8,449,246 B1 * 5/2013 Liang ..... F01D 9/04 415/115
8,459,934 B2 6/2013 Hofmann et al.
8,727,704 B2 * 5/2014 Lee ..... F01D 11/08 415/116
8,814,507 B1 8/2014 Campbell
8,985,940 B2 * 3/2015 Zhang ..... F01D 25/08 415/115
9,028,744 B2 5/2015 Durocher
9,611,754 B2 * 4/2017 Taylor ..... F01D 25/12
9,677,412 B2 * 6/2017 Jones ..... F01D 25/246
9,689,273 B2 * 6/2017 Jones ..... F01D 11/005
9,784,125 B2 10/2017 Duguay
9,920,647 B2 * 3/2018 Jones ..... F01D 11/24
9,926,799 B2 3/2018 Romanov et al.
10,107,128 B2 * 10/2018 Romanov ..... F01D 25/12
10,174,622 B2 1/2019 Zhang et al.
2004/0001753 A1 1/2004 Tiemann
2005/0111965 A1 5/2005 Lowe
2005/0214156 A1 9/2005 Troitski et al.
2010/0025001 A1 2/2010 Lee et al.
2011/0033331 A1 2/2011 Tuppen et al.
2011/0250560 A1 10/2011 Kwon et al.
2012/0186768 A1 7/2012 Sun et al.
2013/0028704 A1 1/2013 Thibodeau
2016/0169016 A1 6/2016 Blaney
2016/0305262 A1 10/2016 Durocher

* cited by examiner

TURBINE SHROUD COOLING

CROSS-REFERENCE TO RELATED APPLICATIONS

This application is a divisional of U.S. application Ser. No. 15/840,088 filed Dec. 13, 2017, the entire contents of which is incorporated by reference herein.

TECHNICAL FIELD

The application relates generally to turbine shrouds and, more particularly, to turbine shroud cooling.

BACKGROUND OF THE ART

Turbine shroud segments are exposed to hot gases and, thus, require cooling. Cooling air is typically bled off from the compressor section, thereby reducing the amount of energy that can be used for the primary purposed of proving trust. It is thus desirable to minimize the amount of air bleed of from other systems to perform cooling. Various methods of cooling the turbine shroud segments are currently in use and include impingement cooling through a baffle plate, convection cooling through long EDM holes and film cooling.

Although each of these methods have proven adequate in most situations, advancements in gas turbine engines have resulted in increased temperatures and more extreme operating conditions for those parts exposed to the hot gas flow.

SUMMARY

In one aspect, there is provided a turbine shroud segment for a gas turbine engine having an annular gas path extending about an engine axis; the turbine shroud segment comprising: a body having a radially outer surface and a radially inner surface extending axially between a leading edge and a trailing edge and circumferentially between a first and a second lateral edge; a first serpentine channel disposed axially along the first lateral edge; and a second serpentine channel disposed axially along the second lateral edge, the first serpentine channel and the second serpentine channel each defining a tortuous path including axially extending passages between a front inlet proximate the leading edge and a rear outlet at the trailing edge of the body.

In another aspect, there is provided a method of manufacturing a turbine shroud segment having an arcuate body extending axially between a leading edge and a trailing edge and circumferentially between a first lateral edge and a second lateral edge; the method comprising: casting the arcuate body over a sacrificial core to form first and second axial serpentine channels respectively along the first and second lateral edges; the first and second axial serpentine channels being embedded in the arcuate body and bounded by opposed radially inner and radially outer surfaces of the cast arcuate body, the first and second serpentine channels having inlets disposed at a front end of the arcuate body proximate the leading edge thereof and outlets at the trailing edge.

DESCRIPTION OF THE DRAWINGS

Reference is now made to the accompanying figures in which.

DETAILED DESCRIPTION

Figure 1:
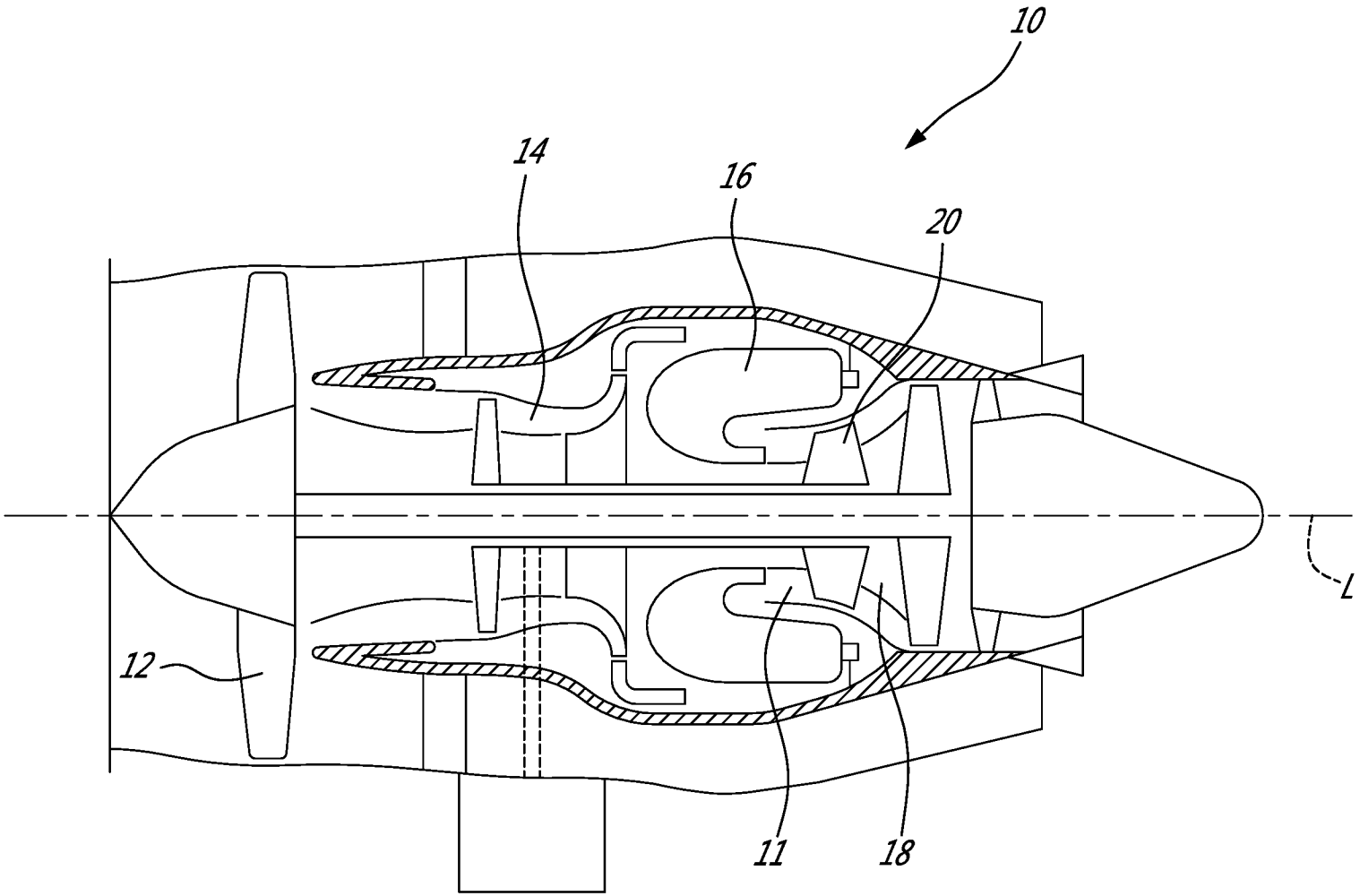
FIG. 1 is a schematic cross-sectional view of a gas turbine engine.

FIG. 1 illustrates a gas turbine engine 10 of a type preferably provided for use in subsonic flight, generally comprising an annular gas path 11 disposed about an engine axis L. A fan 12, a compressor 14, a combustor 16 and a turbine 18 are axially spaced in serial flow communication along the gas path 11. More particularly, the engine 10 comprises a fan 12 through which ambient air is propelled, a compressor section 14 for pressurizing the air, a combustor 16 in which the compressed air is mixed with fuel and ignited for generating an annular stream of hot combustion gases, and a turbine 18 for extracting energy from the combustion gases.

Figure 2:
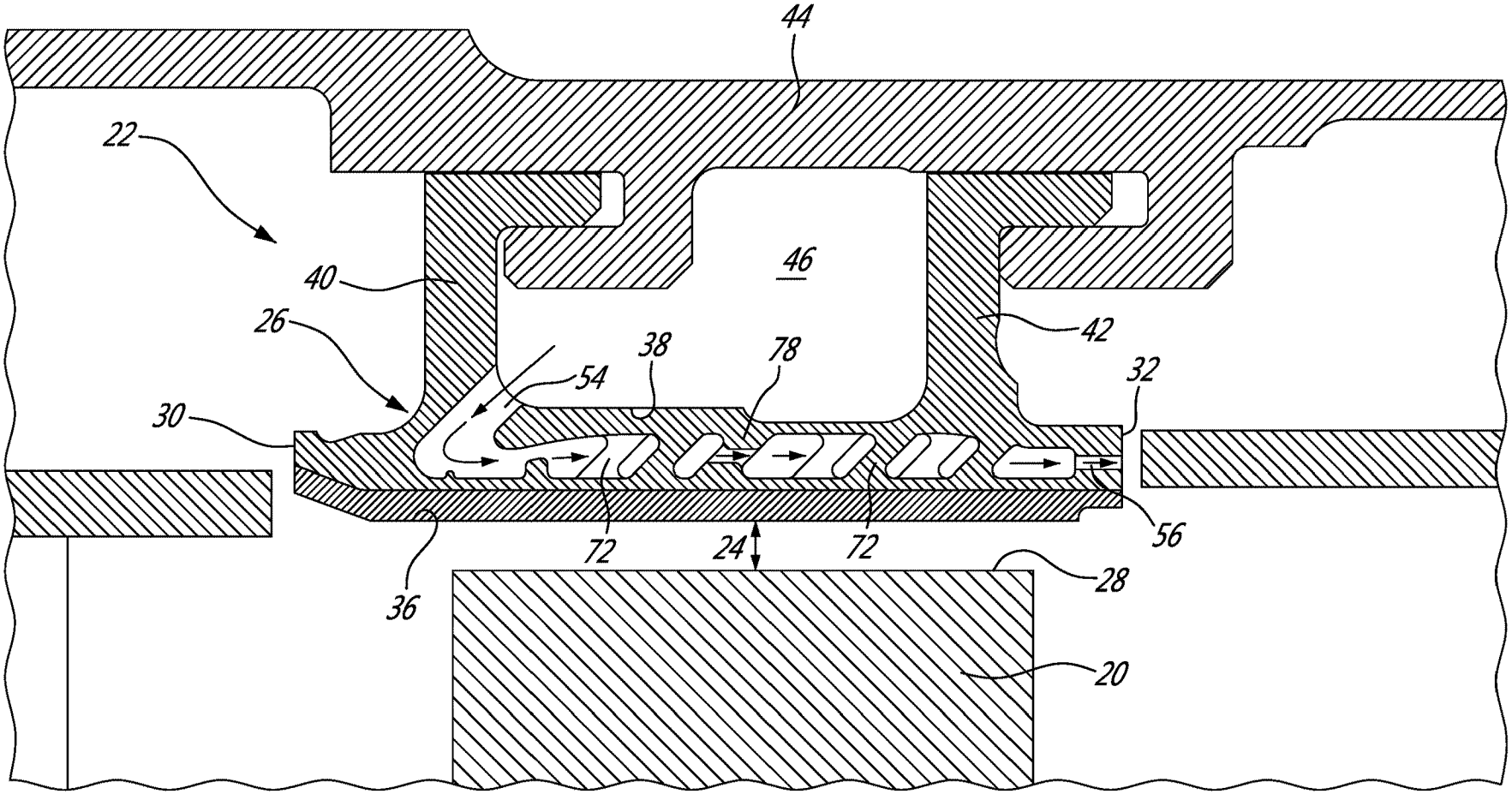
FIG. 2 is a schematic cross-section of a turbine shroud segment mounted radially outwardly in close proximity to the tip of a row of turbine blades of a turbine rotor.

As shown in FIG. 2, the turbine 18 includes turbine blades 20 mounted for rotation about the axis L. A turbine shroud 22 extends circumferentially about the rotating blades 20. The shroud 22 is disposed in close radial proximity to the tips 28 of the blades 20 and defines therewith a blade tip clearance 24. The shroud includes a plurality of arcuate segments 26 spaced circumferentially to provide an outer flow boundary surface of the gas path 11 around the blade tips 28.

Figure 3:
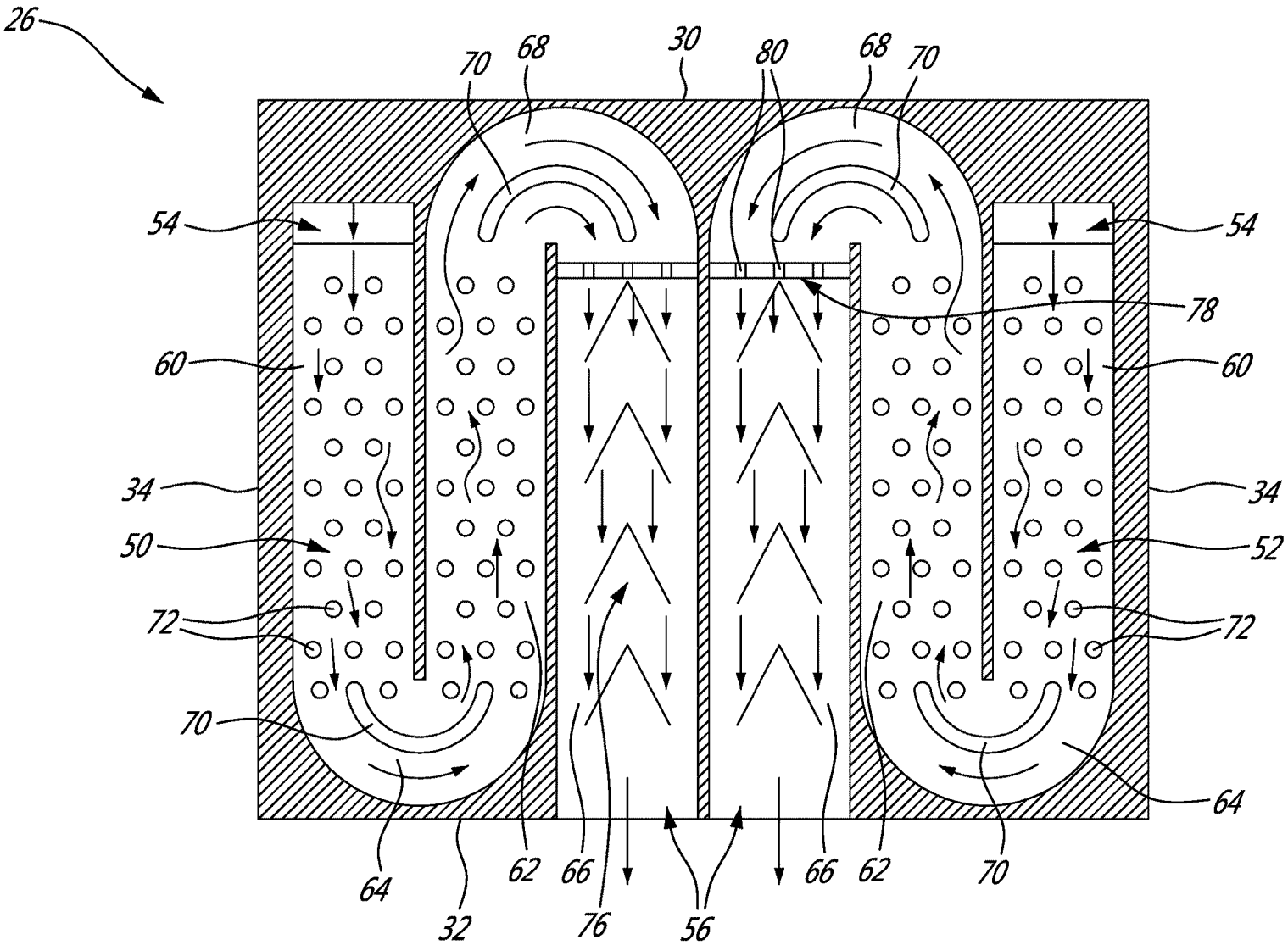
FIG. 3 is a plan cross-section view of a cooling scheme of the turbine shroud segment shown in FIG. 2.

Each shroud segment 26 has a monolithic cast body extending axially from a leading edge 30 to a trailing edge 32 and circumferentially between opposed axially extending edges 34 (FIG. 3). The body has a radially inner surface 36 (i.e. the hot side exposed to hot combustion gases) and a radially outer surface 38 (i.e. the cold side) relative to the engine axis L. Front and rear support legs 40, 42 (e.g. hooks) extend from the radially outer surface 38 to hold the shroud segment 26 into a surrounding fixed structure 44 of the engine 10. A cooling plenum 46 is defined between the front and rear support legs 40, 42 and the structure 44 of the engine 10 supporting the shroud segments 44. The cooling plenum 46 is connected in fluid flow communication to a source of coolant. The coolant can be provided from any suitable source but is typically provided in the form of bleed air from one of the compressor stages.

The shroud segment 26 has an internal cooling scheme obtained from a casting/sacrificial core (not shown). The cooling scheme extends axially from the front end of the shroud body adjacent the leading edge 30 to the trailing edge 32 thereof. As shown in FIG. 3, the cooling scheme comprises a first serpentine channel 50 disposed axially along the first lateral edge 34; and a second serpentine channel 52 disposed axially along the second lateral edge 34. The first serpentine channel 50 and the second serpentine channel 52 each defines a tortuous path including axially extending passages between a front inlet 54 proximate the leading edge 30 and a rear outlet 56 at the trailing edge 32 of the shroud body.

Each inlet 54 may comprise one or more inlet passages extending through the radially outer surface 38 of the shroud segment 26. As shown in FIG. 2, the inlet 54 is in fluid flow communication with the plenum 46. In the illustrated example, the inlet 54 is inclined to direct the coolant forwardly towards the front end of the shroud body. However, it is understood that the inlet 54 could be normal to the radially outer surface 38.

Each outlet 56 may comprise one or more outlet passages extending axially through the trailing edge 32 of the shroud segment 26. In the illustrated embodiment, the outlets 56 of the first and second serpentine channels 50, 52 are disposed in a central area of the trailing edge 32 between the lateral edges 34 inboard relative to the inlets 54.

Each serpentine channel 50, 52 comprises a first axially extending passage 60 interconnected in fluid flow communication with a second axially extending passage 62 by a first bend passage 64 and a third axially extending passage 66 interconnected in fluid flow communication with the second axially extending passage 62 by a second bend passage 68. The first axially extending passage 60 is disposed adjacent to the associated lateral edge 34 of the shroud segment 26. The second axially extending passage 62 is disposed laterally inboard relative to the first passage 60. The third axially extending passage 66 is, in turn, disposed laterally inboard relative to the second passage 62 and extends rearwardly to the outlets 56 in the trailing edge 32 of the shroud segment 26. It can be appreciated that the third passages 66 of the first and second serpentine channels 50, 52 are adjacent to each other and disposed in the central area of the shroud segment between the lateral edges 34. It is understood that each serpentine channels could have more than three axially extending passages and two bend passages.

The lateral edges 34 of the shroud segment are hotter than the central area thereof. By providing the first passage of each serpentine channel along the lateral edges, cooler air is available for cooling the hot lateral edges. This contributes to maintain a more uniform temperature distribution throughout the shroud segment.

The first bend passage 64 is disposed proximate the trailing edge 32. The second bend passage 68 is disposed proximate the leading edge 30. A turning vane 70 is provided in the first and second bend passages 64, 68 to avoid flow separation. The turning vanes 70 are configured to redirect the flow of coolant from a first axial direction to a second axial direction 180 degrees opposite to the first axial direction. Outlet holes (not shown) could be provided in the outer radius of the first bend passages 64 for exhausting a fraction of the coolant flow through the trailing edge 32 of the shroud segment 26 as the coolant flows through the first bend passages 64.

As best shown in FIG. 3, turbulators may be provided in the first, second and third passages 60, 62 and 66 of each of the first and second serpentine channels 50, 52. According to the illustrated embodiment, pedestals 72 are provided in the first and second axial passages 60, 62 upstream and downstream of the turning vane 70 in the first bend passage 64. As shown in FIG. 2, the pedestals 72 extend integrally from the radially inner surface 36 to the radially outer surface 38 of the shroud segment 26. If the inlets 54 are cast at an angle (e.g. 45 degrees) as shown in FIG. 2, the pedestals 72 can be cast at the same angle as that of the inlets 54 to facilitate de-molding of the core used to form the first and second serpentine channels 50, 52.

The turbulators in the third axial passage 66 of each of the first and second serpentine channels 50, 52 can be provided in the form of axially spaced-part V-shaped chevrons 76. The chevrons 76 can be axially aligned with the apex of the chevrons 76 pointing in the upstream direction.

The first and second serpentine channels 50, 52 can also each include a cross-over wall 78 having a transverse row of cross-over holes 80 for metering and accelerating coolant flow at the entry of the third axial passage 66. The cross-over walls 78 may be disposed at the exit of the second bend passages 68 just upstream of the chevrons 76. The cross-sectional area of the cross-over holes 80 is selected to be less than the cross-section area of the associated inlet 54 to provide the desired metering and flow accelerating functions. It is also contemplated to provide a cross-over wall in the first or second axial passage 60, 62.

The pedestals 72, the chevrons 76 and the cross-over walls 78 allow increasing and tailoring the heat transfer coefficient and, thus, provide for a more uniform temperature distribution across the shroud segment 26. Different heat transfer coefficients can be provided over the surface area of the shroud segment to account for differently thermally loaded shroud regions.

The shroud segments 26 may be cast via an investment casting process. In an exemplary casting process, a sacrificial core (not shown), for instance a ceramic core, is used to form the first and second serpentine channels 50, 52 (including the pedestals 54, the turning vanes 70, the cross-over walls 78 and the chevrons 76), the cooling inlets 54 as well as the cooling outlets 56. The core is over-molded with a material forming the body of the shroud segment 26. That is the shroud segment 26 is cast around the core. Once, the material has formed around the core, the core is removed from the shroud segment 26 to provide the desired internal configuration of the shroud cooling scheme. The core may be leached out by any suitable technique including chemical and heat treatment techniques. As should be appreciated, many different construction and molding techniques for forming the shroud segments are contemplated. For instance, the cooling inlets 54 and outlets 56 could be drilled as opposed of being formed as part of the casting process. Also some of the inlets 60 and outlets 62 could be drilled while others could be created by corresponding forming structures on the core. Various combinations are contemplated.

According to one example, a method of manufacturing a turbine shroud segment comprises: casting an arcuate body over a sacrificial core to form first and second axial serpentine channels respectively along first and second lateral edges of the body; the first and second axial serpentine channels being embedded in the arcuate body and bounded by opposed radially inner and radially outer surfaces of the cast arcuate body, the first and second serpentine channels having inlets disposed at a front end of the arcuate body proximate a leading edge thereof and outlets at a trailing edge of the shroud body.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. A method of manufacturing a turbine shroud segment having an arcuate body extending axially between a leading edge and a trailing edge and circumferentially between a first lateral edge and a second lateral edge; the method comprising: casting the arcuate body over a sacrificial core to form first and second axial serpentine channels respectively along the first and second lateral edges; the first and second axial serpentine channels being embedded in the arcuate body and bounded by opposed radially inner and radially outer surfaces of the cast arcuate body, the first and second serpentine channels having inlets disposed at a front end of the arcuate body proximate the leading edge thereof and outlets at the trailing edge, and using the sacrificial core to form crossover walls in the first and second serpentine channels, the crossover walls having crossover holes for metering a flow of coolant through the first and second serpentine channels.

2. The method of claim 1, further comprising using the sacrificial core to create turning vanes in the first and second serpentine channels.

3. The method of claim 2, further comprising using the sacrificial core to create pedestals in the first and second serpentine channels upstream and downstream of the turning vanes.

4. The method of claim 1, further comprising using the sacrificial core to form axially spaced-apart chevrons in the first and second serpentine channels downstream of the crossover walls.

5. The method of claim 1, further comprising using the sacrificial core to form inlets for the first and second cooling channels, the inlets being located in a front end portion of the radially outer surface of the turbine shroud segment.

6. The method of claim 5, further comprising using the sacrificial core to form the exits in a central area of the trailing edge between the first and second lateral edges.

* * * * *